US008580470B2

(12) United States Patent
Otsuka et al.

(10) Patent No.: US 8,580,470 B2
(45) Date of Patent: Nov. 12, 2013

(54) CHARGE CONTROL AGENT COMPOSITION AND TONER UTILIZING THE SAME

(75) Inventors: Hideyuki Otsuka, Koriyama (JP); Masaki Okubo, Koriyama (JP); Osamu Mukudai, Tokyo (JP)

(73) Assignee: Hodogaya Chemical Co., Ltd., Tokyo (JP)

( * ) Notice: Subject to any disclaimer, the term of this patent is extended or adjusted under 35 U.S.C. 154(b) by 267 days.

(21) Appl. No.: 12/297,819

(22) PCT Filed: Apr. 16, 2007

(86) PCT No.: PCT/JP2007/058293

§ 371 (c)(1),
(2), (4) Date: Jul. 28, 2011

(87) PCT Pub. No.: WO2007/123091

PCT Pub. Date: Nov. 1, 2007

(65) Prior Publication Data

US 2009/0104554 A1 Apr. 23, 2009

(30) Foreign Application Priority Data

Apr. 19, 2006 (JP) ..... 2006-115237

(51) Int. Cl.
*G03G 9/097* (2006.01)

(52) U.S. Cl.
USPC ..... 430/108.3; 430/108.4

(58) Field of Classification Search
USPC ..... 430/108.3, 108.4
See application file for complete search history.

(56) References Cited

U.S. PATENT DOCUMENTS

| | | | | |
|---|---|---|---|---|
| 5,350,657 | A * | 9/1994 | Anno et al. | 430/108.1 |
| 5,354,610 | A * | 10/1994 | Ozawa et al. | 428/323 |
| 5,645,967 | A * | 7/1997 | Sato et al. | 430/108.1 |
| 6,087,058 | A * | 7/2000 | Semura et al. | 430/109.4 |
| 6,391,825 | B1 * | 5/2002 | Arai et al. | 503/227 |
| 7,094,512 | B2 | 8/2006 | Otsuka et al. | |
| 2003/0224275 | A1 | 12/2003 | Shimojo et al. | |
| 2004/0191660 | A1 | 9/2004 | Otsuka et al. | |
| 2005/0277040 | A1 | 12/2005 | Michel et al. | |
| 2006/0020069 | A1 | 1/2006 | Michel et al. | |

FOREIGN PATENT DOCUMENTS

| | | |
|---|---|---|
| JP | 62-163061 | 7/1987 |
| JP | 63-002074 | 1/1988 |
| JP | 63-033755 | 2/1988 |
| JP | 63-208865 | 8/1988 |
| JP | 63-237065 | 10/1988 |
| JP | 64-010261 | 1/1989 |
| JP | 4-083262 | 3/1992 |
| JP | 7-36223 | 2/1995 |
| JP | 10-221878 | 8/1998 |
| JP | 2002-082475 | 3/2002 |
| JP | 2003-241429 | 8/2003 |
| JP | 2003-337444 | 11/2003 |
| JP | 2003-345069 | 12/2003 |
| JP | 2006-500605 | 1/2006 |
| JP | 2006-503313 | 1/2006 |
| KR | 10-2005-0123114 | 12/2005 |

OTHER PUBLICATIONS

Grant, R., et al., ed., Grant & Hackh's Chemical Dictionary, fifth edition, McGraw-Hill Book Company, NY (1987), pp. 68. 140, 321, and 594.*

Chinese Office Action dated Oct. 28, 2010 that issued with respect to Chinese Patent Application No. 200780013859.4, along with an English language translation thereof.

English language Abstract of DE 10235571, corresponding to JP 2006-500605.

English language Abstract of DE 10235570, corresponding to JP 2006-503313.

International Search Report issued with respect to PCT/JP2007/058293, mailed Jul. 31, 2007.

International Preliminary Report on Patentability, including the Written Opinion (in English) for PCT/JP2007/058293, mailed Nov. 27, 2008.

Japan Office action that issued with respect to patent family member Japanese Patent Application No. 2008-512104, dated May 1, 2012 along with an english translation thereof.

Office action in Korean application No. 2008-7025433, mail date is Aug. 19, 2013.

* cited by examiner

*Primary Examiner* — Janis L Dote
(74) *Attorney, Agent, or Firm* — Greenblum & Bernstein, P.L.C.

(57) ABSTRACT

A modified charge control agent composition comprising a metal compound (A) of aromatic hydroxycarboxylic acid bonded with a metal atom selected from a zirconium atom, a calcium atom, an aluminum atom, a chromium atom, a boron atom, and a zinc atom via at least one of an ionic bond, a covalent bond, and a coordinate bond; and at least one inorganic pigment (B), wherein the pigment (B) is contained in an amount of from 1 to 20 parts by mass in 100 parts by mass of the composition. The modified charge control agent composition exhibits a high charge-imparting effect, and an electrostatic image developing toner that contains the charge control agent composition will have a high electrostatic charge amount and a high environmental stability.

10 Claims, No Drawings

CHARGE CONTROL AGENT COMPOSITION AND TONER UTILIZING THE SAME

TECHNICAL FIELD

The present invention relates to a charge control agent to be used in an image-forming apparatus used for developing an electrostatic latent image in the field of an electrophotograph, an electrostatic recording material, etc., and a negatively chargeable toner containing such a charge control agent.

BACKGROUND ART

In an image-forming process by an electrophotographic system, a visible image is obtained by forming an electrostatic latent image on a photosensitive material comprising an inorganic or organic material, developing the electrostatic latent image with a toner, transferring the developed image onto paper, a plastic film or the like, and fixing the transferred image thereon. The photosensitive material has a positive chargeability or a negative chargeability depending on its constitution, and when leaving an electrostatic image on a part to be printed by light exposure, development is carried out with a reversely charged toner. On the other hand, when carrying out reverse development by destaticizing a part to be printed, development is carried out with the same side charged toner.

A toner comprises a binder resin, a colorant and other additives. A charge control agent is usually added in order to provide satisfactory chargeabilities (including a charging speed, a charging level, a charging stability, etc), a desirable stability as a lapse of time and a satisfactory environmental stability. Properties of the toner are substantially improved by addition of the charge controlling agent.

Today, as a positively triboelectrically chargeable charge control agent known in this technical field, a nigrosine dye, an azine dye, a copper phthalocyanine pigment, a quaternary ammonium salt or a polymer having a quaternary ammonium salt in its side chain is, for example, known. As a negatively triboelectrically chargeable charge control agent, a metal complex salt of a monoazo dye, a metal complex salt of salicylic acid, naphthoic acid or dicarboxylic acid, a copper phthalocyanine dye or a resin containing an acid component is, for example, known.

In the case of a color toner, the market of which is expected to expand in future, a light-colored, preferably colorless, charge control agent which presents no influence over the hue, is indispensable. As a conventional colorless, white or light-colored negatively triboelectrically chargeable charge control agent, a compound utilizing an organic carboxylic acid derivative is known.

However, such a charge control agent is a chromium compound which is problematic against environmental safety which is expected to become more important in future, or a compound having no adequate colorless or light-colored level required for a color toner, or it has had a drawback such that the electrification effect is inadequate, the toner tends to be reversibly electrified, or the dispersibility or the stability of the compound itself is poor.

As a conventional charge control agent, an electrophotographic toner containing a calcium salt of 3,5-di-tert-butylsalicylic acid (e.g. Patent Document 1), a zinc salicylate compound (e.g. Patent Documents 2 to 4) or an aluminum salicylate compound (e.g. Patent Documents 5 to 7) is disclosed.

The charge control agent being a 3,5-di-tert-dibutylsalicylic acid compound disclosed in these Patent Documents, is light-colored or white-colored and contains no heavy metal such as chromium, and thus is applicable to a color toner, and it is a charge control agent, whereby a problem of a heavy metal such as chromium is taken into account. However, it has drawbacks such that the charge-imparting effect is lower than the level required today, the rising speed of electrostatic charge is inadequate, whereby the initial reproduction image tends to be poor in clearness, the quality of the reproduced image is likely to change during continuous copying, or the fluctuation range of the electrostatic charge characteristics of the toner against the environmental conditions such as the temperature, humidity, etc. is large, and the image quality is likely to substantially change due to the seasonal factor or the like. Accordingly, a charge control agent having high charge-imparting effect has been desired.

Patent Document 1: JP-A-62-163061
Patent Document 2: JP-A-63-002074
Patent Document 3: JP-A-63-033755
Patent Document 4: JP-A-4-083262
Patent Document 5: JP-A-63-208865
Patent Document 6: JP-A-63-237065
Patent Document 7: JP-A-64-010261

DISCLOSURE OF THE INVENTION

Object to be Accomplished by the Invention

It is an object of the present invention to provide a modified charge control agent composition having a high charge-imparting effect, prepared from a metal compound (A) of aromatic hydroxycarboxylic acid and an inorganic pigment (B), and a toner for developing an electrostatic image containing such a charge control agent composition and having a high electrostatic charge and stability.

Means to Accomplish the Object

The present invention provides the following:

(1) A charge control agent composition comprising a metal compound (A) of aromatic hydroxycarboxylic acid having an aromatic hydroxycarboxylic acid bonded with a metal atom selected from a zirconium atom, a calcium atom, an aluminum atom, a chromium atom, a boron atom and a zinc atom via at least any of ionic bond, covalent bond and coordinate bond; and at least one inorganic pigment (B), wherein the pigment (B) is contained in an amount of from 1 to 20 parts by mass in 100 parts by mass of the composition.

(2) The charge control agent composition according to the above (1), wherein the pigment (B) is a white pigment of calcium carbonate, magnesium carbonate, barium carbonate, zinc carbonate, barium sulfate, calcium sulfate, magnesium hydroxide, aluminum hydroxide, calcium silicate, aluminum silicate, zinc silicate, magnesium silicate, dimagnesium phosphate, titanium dioxide, kaolin, talc, clay, diatomaceous earth, synthetic amorphous silica, alumina or zeolite.

(3) The charge control agent composition according to any one of the above (1) and (2), wherein the metal compound (A) of aromatic hydroxycarboxylic acid is a metal compound having 3,5-di-tert-butylsalicylic acid bonded with a metal atom selected from a zirconium atom, a calcium atom, an aluminum atom, a chromium atom, a boron atom and a zinc atom.

(4) A negatively chargeable toner comprising the charge control agent composition as defined in any one of the above (1) to (3), a colorant and a binder resin.

(5) The negatively chargeable toner according to the above (4), wherein the content of the charge control agent composition is from 0.1 to 10 parts by mass per 100 parts by mass of the binder resin.

(6) The negatively chargeable toner according to the above (4) or (5), wherein the binder resin has an acid value of from 0.1 to 100 mgKOH/g.

(7) The negatively chargeable toner according to any one of the above (4) to (6), wherein the colorant is a magnetic substance.

(8) The negatively chargeable toner according to any one of the above (4) to (6), wherein the colorant is a non-magnetic colorant, and its content is from 0.1 to 20 parts by mass per 100 parts by mass of the binder resin.

(9) The negatively chargeable toner according to any one of the above (4) to (8), which further contains a wax.

(10) The negatively chargeable toner according to any one of the above (4) to (9), which has a volume average particle diameter of from 2 to 15 μm.

(11) A one component developer comprising the negatively chargeable toner as defined in any one of the above (4) to (10).

(12) A two component developer comprising a negatively chargeable toner and a carrier, wherein the negatively chargeable toner comprises at least a binder resin, a colorant and a charge control agent composition, and the charge control agent composition is the charge control agent composition as defined in any one of the above (1) to (3).

(13) The two component developer according to the above (12) wherein the content of the charge control agent composition is from 0.1 to 10 parts by mass per 100 parts by mass of the binder resin.

(14) The two component developer according to the above (12) or (13), wherein the binder resin in the negatively chargeable toner is a styrene/acrylate resin.

(15) The two component developer according to the above (14), wherein the binder resin has an acid value of from 0.1 to 100 mgKOH/g.

(16) The two component developer according to any one of the above (12) to (15) which further contains a wax.

(17) The two component developer according to any one of the above (12) to (16), wherein the negatively chargeable toner has a volume average particle diameter of from 2 to 15 μm.

(18) The two component developer according to any one of the above (12) to (17), wherein the carrier is a resin-coated carrier.

Effects of the Invention

The charge control agent composition of the present invention presents excellent rising in electrostatic charge and is capable of electrostatically charging a toner in short time as compared with a conventional charge control agent. Further, also with respect to the electrostatic charge, it has a high charge-imparting effect, and the electrostatic charge is stable against a change of environment such as the ambient temperature, humidity or the like.

With the toner containing such a charge control agent composition, it is possible to obtain an excellent image in a developing system employing either a one component developer or a two component developer, with respect to evaluation of image characteristics such as the image density, fogging density, dot reproducibility, fine line reproducibility, etc.

BEST MODE FOR CARRYING OUT THE INVENTION

In the present invention, the metal compound (A) of aromatic hydroxycarboxylic acid is meant for a compound having a bond between an oxygen atom on a carboxyl group bonded to an aromatic ring of an aromatic hydroxycarboxylic acid and a metal atom selected from a zirconium atom, a calcium atom, an aluminum atom, a chromium atom, a boron atom and a zinc atom. This bond may take at least any bond form of ionic bond, covalent bond and coordinate bond, and there may be a further bond with such a metal atom at a site other than the carboxyl group on the metal compound (A) of aromatic hydroxycarboxylic acid.

The aromatic hydroxycarboxylic acid in the metal compound (A) of aromatic hydrocarboxylic acid of the present invention may, for example, be salicylic acid, a monoalkyl salicylic acid having one linear or branched alkyl group having from 1 to 12 carbon atoms, a dialkylsalicylic acid having two linear or branched alkyl groups having from 1 to 12 carbon atoms, hydroxynaphthoic acid or an alkylhydroxynaphthoic acid, particularly preferably 3,5-di-tert-butylsalicylic acid.

The metal compound (A) of aromatic hydroxycarboxylic acid may, specifically, be a zirconium compound of 3,5-di-tert-butylsalicylic acid, a calcium compound of 3,5-di-tert-butylsalicylic acid, an aluminum compound of 3,5-di-tert-butylsalicylic acid, a chromium compound of 3,5-di-tert-butylsalicylic acid, a boron compound of 3,5-di-tert-butylsalicylic acid, or a zinc compound of 3,5-di-tert-butylsalicylic acid. The most preferred compound is a zirconium compound of 3,5-di-tert-butylsalicylic acid.

The metal compound (A) of aromatic hydroxycarboxylic acid may be any so long as it is a compound having a bond between an oxygen atom on the carboxyl group bonded to the aromatic ring and the specific metal atom, and for example, it may be a compound containing a double bond between a zirconium atom and an oxygen atom other than the oxygen atom on the carboxyl group bonded to the aromatic ring, like a compound obtainable from a metal oxide such as zirconium oxychloride and 3,5-di-tert-butylsalicylic acid.

The inorganic pigment (B) to be used in the present invention is a white pigment of calcium carbonate, magnesium carbonate, barium carbonate, zinc carbonate, barium sulfate, calcium sulfate, magnesium hydroxide, aluminum hydroxide, calcium silicate, aluminum silicate, zinc silicate, magnesium silicate, dimagnesium phosphate, titanium dioxide, kaolin, talc, clay, diatomaceous earth, synthetic amorphous silica, alumina or zeolite. Otherwise, an inorganic pigment subjected to coating treatment with e.g. an organic compound, an organic polymer, a hydrophobic treating agent, a titanate coupling agent or the like, may also be employed.

As the inorganic pigment (B), either a synthetic product or a natural product may be used. Otherwise, it is also possible to use a reaction solution of an inorganic pigment formed by a reaction. For example, it may be a mixture of barium sulfate and aluminum hydroxide obtainable by a reaction of barium chloride and aluminum sulfate with an alkali, a mixture of zinc carbonate and sodium sulfate obtainable by a reaction of sodium carbonate and zinc sulfate, calcium carbonate obtainable by a reaction of sodium carbonate and calcium chloride, or calcium sulfate obtainable by a reaction of sodium sulfate and calcium chloride.

There is no particular restriction to the combination of the metal compound (A) of aromatic hydroxycarboxylic acid and the inorganic pigment (B).

Further, in the charge control agent composition of the present invention, the metal compound (A) of aromatic hydroxycarboxylic acid is contained in an amount of from 50 to 99 parts by mass, preferably from 80 to 99 parts by mass, more preferably from 90 to 95 parts by mass, per 100 parts by mass of the composition.

On the other hand, the inorganic pigment (B) is contained, per 100 parts by mass of the charge control agent composition of the present invention, from 1 to 50 parts by mass from the viewpoint of the rising performance in electrostatic charging of the obtainable toner for developing an electrostatic image, or preferably from 1 to 20 parts by mass, further preferably from 5 to 10 parts by mass, from the viewpoint of the electrostatic charge stability against environmental conditions such as the temperature, humidity, etc.

The charge control agent composition of the present invention is one prepared from the metal compound (A) of aromatic hydroxycarboxylic acid and the inorganic pigment (B). As the method for preparing the charge control agent composition comprising the metal compound (A) of aromatic hydroxycarboxylic acid and the inorganic pigment (B), any method may be employed so long as it is a method whereby a uniform composition can be obtained. It is preferred that at the time of producing the metal compound (A) of aromatic hydroxycarboxylic acid, the inorganic pigment (B) is added at any stage of the production process to obtain a uniform charge control agent composition comprising the metal compound (A) of aromatic hydroxycarboxylic acid as a reaction product and the inorganic pigment (B), as a final product.

It is particularly preferred to add the inorganic pigment (B) by permitting it to be present together with the reaction starting compound in the reaction system to prepare the metal compound (A) of aromatic hydroxycarboxylic acid. Otherwise, it may be added into a reaction mixture to be transferred from the reaction step for forming the metal compound (A) of aromatic hydroxycarboxylic acid to its purification step, or it may be added by mixing it to a wet cake-form filtration product obtained from the purification step. It may be a method wherein the metal compound (A) of aromatic hydroxycarboxylic acid formed by the reaction is subjected to filtration and dried, and immediately thereafter the inorganic pigment (B) is added, followed by pulverization and mixing to prepare a uniform charge control agent composition.

It is also possible to obtain a charge control agent composition having the same performance by uniformly mixing by a wet system the dried metal compound (A) of aromatic hydroxycarboxylic acid and the inorganic pigment (B) in a suitable solvent such as water, a mixture of water and an organic solvent, or an organic solvent alone.

Further, it is possible to obtain a charge control agent composition having the same performance by mixing the dried metal compound (A) of aromatic hydroxycarboxylic acid and the inorganic pigment (B) by a dry system by means of a magnetic mortar or a suitable mixer such as a HENSCHEL mixer, super mixer, juicer mixer or ball mill.

The charge control agent composition obtained by the above method may be used as it is for the production of a toner, after drying, or, if necessary, it may further be pulverized, classified and then used.

The charge control agent composition of the present invention is excellent in environmental stability and also excellent in an electrostatic charge control effect. By using the charge control agent composition of the present invention for a toner, it is possible to obtain quick rising and high electrostatic charge, and as a result, it is possible to obtain a clear image.

The method for incorporating the charge control agent composition to a toner of the present invention may be a method of adding it together with a colorant, etc. to a binder resin, followed by kneading and pulverization (pulverized toner) or a method of adding the charge control agent composition to a polymerizable monomer, followed by polymerization to obtain a toner (polymerized toner). When incorporated to the toner, the amount of the charge control agent composition of the present invention is preferably from 0.1 to 10 parts by mass, more preferably from 0.2 to 5 parts by mass, per 100 parts by mass of the binder resin.

Further, the charge control agent composition of the present invention may be used in combination with another known negatively chargeable charge control agent. A preferred charge control agent to be used in combination may, for example, be an azo type iron complex or complex salt, an azo type chromium complex or complex salt, an azo type manganese complex or complex salt, an azo type cobalt complex or complex salt, an azo type zirconium complex or complex salt, or a chromium complex or complex salt of a carboxylic acid derivative other than the present invention, a zinc complex or complex salt of a carboxylic acid derivative other than the present invention, an alumina complex or complex salt of a carboxylic acid derivative other than the present invention or a zirconium complex or complex salt of a carboxylic acid derivative other than the present invention. Such a carboxylic acid derivative is preferably an aromatic hydroxycarboxylic acid, more preferably 3,5-di-tert-butylsalicylic acid. Further, a preferred charge control agent to be used in combination may, for example, be a boron complex or complex salt, a negatively chargeable resin type charge control agent or the like.

As the binder resin to be used in the present invention, any of known binder resins may be used. For example, a vinyl polymer of e.g. a styrene type monomer, an acrylate type monomer or a methacrylate type monomer, or a copolymer made of at least two types of such monomers; a polyester type polymer, a polyol resin, a phenol resin, a silicone resin, a polyurethane resin, a polyamide resin, a furan resin, an epoxy resin, a xylene resin, a terpene resin, a coumaroneindene resin, a polycarbonate resin or a petroleum resin may, for example, be mentioned.

The styrene type monomer, acrylate type monomer and methacrylate type monomer to form the above vinyl polymer or copolymer will be exemplified below, but they are not limited to the exemplified ones.

The styrene type monomer may, for example, be a styrene such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene or p-nitrostyrene, or its derivatives.

The acrylate type monomer may, for example, be acrylic acid or its ester such as methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate or phenyl acrylate.

The methacrylate type monomer may, for example, be methacrylic acid or its ester such as methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate or diethylaminoethyl methacrylate.

As other examples of the monomer to form the vinyl polymer or copolymer, the following (1) to (18) may be mentioned.

(1) A monoolefin such as ethylene, propylene, butylene or isobutylene;

(2) A polyene such as butadiene or isoprene;

(3) A vinyl halide such as vinyl chloride, vinylidene chloride, vinyl bromide or vinyl fluoride;

(4) A vinyl ester such as vinyl acetate, vinyl propionate or vinyl benzoate;

(5) A vinyl ether such as vinyl methyl ether, vinyl ethyl ether or vinyl isobutyl ether;

(6) A vinyl ketone such as vinyl methyl ketone, vinyl hexyl ketone or methyl isopropenyl ketone;

(7) An N-vinyl compound such as N-vinylpyrrole, N-vinylcarbazole, N-vinylindole or N-vinylpyrrolidone;

(8) A vinyl naphthalene;

(9) A derivative of acrylic acid or methacrylic acid, such as acrylonitrile, methacrylonitrile or acrylamide;

(10) A unsaturated dibasic acid such as maleic acid, citraconic acid, itaconic acid, an alkenylsuccinic acid, fumaric acid or mesaconic acid;

(11) An unsaturated dibasic anhydride such as maleic anhydride, citraconic anhydride, itaconic anhydride or alkenylsuccinic anhydride;

(12) A monoester of an unsaturated dibasic acid such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate or monomethyl mesaconate;

(13) A diester of an unsaturated dibasic acid such as dimethyl maleate or dimethyl fumarate;

(14) An α,β-unsaturated acid such as crotonic acid or cinnamic acid;

(15) An α,β-unsaturated acid anhydride such as crotonic anhydride or cinnamic anhydride;

(16) A monomer having a carboxyl group, such as an anhydride of α,β-unsaturated acid and a lower fatty acid, or an alkenyl malonic acid, an alkenyl glutaric acid, an alkenyl adipic acid or an acid anhydride thereof or a monomester thereof;

(17) A hydroxyalkyl ester of acrylic acid or methacrylic acid, such as 2-hydroxyethyl acrylate, 2-hydroxyethyl methacrylate or 2-hydroxypropyl methacrylate;

(18) a monomer having a hydroxyl group such as 4-(1-hydroxy-1-methylbutyl)styrene or 4-(1-hydroxy-1-methylhexyl)styrene.

In the toner of the present invention, the vinyl polymer or copolymer for the binder resin may have a crosslinked structure crosslinked by a crosslinking agent having at least two vinyl groups.

The aromatic divinyl compound as such a crosslinking agent may, for example, be divinylbenzene or divinylnaphthalene.

Further, a diacrylate compound bonded by an alkyl chain as such a crosslinking agent, may, for example, be ethylene glycol diacrylate, 1,3-butylene glycol diacrylate, 1,4-butanediol diacrylate, 1,5-pentanediol diacrylate, 1,6-hexanediol diacrylate or neopentyl glycol diacrylate. Further, a dimethacrylate compound bonded by an alkyl chain in the same manner may be mentioned as the crosslinking agent.

A diacrylate compound bonded by an alkyl chain containing an ether bond as such a crosslinking agent may, for example, be diethylene glycol diacrylate, triethylene glycol diacrylate, tetraethylene glycol diacrylate, polyethylene glycol #400 diacrylate, polyethylene glycol #600 diacrylate or dipropylene glycol diacrylate. Further, a dimethacrylate compound bonded by an alkyl chain containing an ether bond in the same manner may be mentioned as the crosslinking agent.

Further, a diacrylate compound or dimethacrylate compound bonded by a chain containing an aromatic group and an ether bond may also be mentioned as the crosslinking agent. Further, as a polyester type diacrylate, one known by the tradename MANDA (manufactured by Nippon Kayaku Co., Ltd.) may, for example, be mentioned.

As a polyfunctional crosslinking agent, pentaerythritol triacrylate, trimethylolethane triacrylate, trimethylolpropane triacrylate, tetramethylolmethane tetraacrylate or oligoester acrylate may, for example, be mentioned. Further, a similar dimethacrylate compound such as triallyl cyanurate or triallyl trimellitate may, for example, be mentioned as the crosslinking agent.

Such a crosslinking agent may be used in an amount of preferably from 0.01 to 10 parts by mass, particularly preferably from 0.03 to 5 parts by mass, per 100 parts by mass of other monomer components. Among such crosslinkable monomers, one which may be suitably used from the viewpoint of the fixing property and offset resistance for a resin for toner, is an aromatic divinyl compound, particularly preferably divinylbenzene, and further, a diacrylate compound bonded by a bonding chain containing one ether bond and an aromatic group may be mentioned. Among them, preferred is a combination of monomers which brings about a styrene type copolymer or a styrene/acrylate type copolymer.

The polymerization initiator to be used for the production of the vinyl polymer or copolymer of the present invention may, for example, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), methyl ethyl ketone peroxide, acetylacetone peroxide, cyclohexanone peroxide, 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, diisopropyl peroxydicarbonate, di-2-ethylhexyl peroxydicarbonate, di-n-propyl peroxydicarbonate, di-2-ethoxyethyl peroxycarbonate, diethoxyisopropyl peroxydicarbonate, bis(3-methyl-3-methoxybutyl) peroxycarbonate, acetylcyclohexylsulfonyl peroxide, tert-butyl peroxyacetate, tert-butylperoxyisobutyrate, tert-butylperoxy-2-ethylhexylate, tert-butylperoxy laurate, tert-butyl oxybenzoate, tert-butylperoxy isopropylcarbonate, di-tert-butylperoxy isophthalate, tert-butylperoxy arylcarbonate, isoamylperoxy-2-ethylhexanoate, di-tert-butylperoxy hexahydroterephthalate or t-butylperoxy azelate.

In a case where the binder resin is a styrene/acrylate resin, preferred from the viewpoint of the fixing property, offset property, storage stability, etc. is a resin which has, in the molecular weight distribution by gel permeation chromatography (hereinafter referred to simply as GPC) of a content soluble in tetrahydrofuran (hereinafter referred to simply as THF) of the resin component, at least one peak in a region of molecular weights of from 3,000 to 50,000 (calculated as number average molecular weight, the same applies hereinafter) and at least one peak in a region of molecular weights of at least 100,000. Further, a binder resin is also preferred wherein the THF-soluble content contains from 50 to 90% of a component having a molecular weight distribution of at most 100,000. More preferred is a binder resin having the main peak in a region of molecular weights of from 5,000 to 30,000, most preferably from 5,000 to 20,000.

In a case where the binder resin is a vinyl polymer such as a styrene/acrylate resin, the acid value is preferably from 0.1 mgKOH/g to 100 mgKOH/g, more preferably from 0.1 mgKOH/g to 70 mgKOH/g, particularly preferably from 0.1 mgKOH/g to 50 mgKOH/g.

The alcohol component and the acid component constituting a polyester type polymer as the binder resin, may be the following ones.

A bivalent alcohol component may, for example, be ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, or a diol obtainable by polymerizing a cyclic ether such as ethylene oxide or propylene oxide to bisphenol A.

In order to crosslink a polyester type polymer, it is preferred to use a trihydric or higher hydric alcohol in combination. The trihydric or higher hydric alcohol may, for example, be sorbitol, 1,2,3,4-hexanetetrol, 1,4-sorbitan, pentaerythritol, dipentaerythritol, tripentaerythritol, 1,2,4-butanetriol, 1,2,5-pentatriol, glycerol, 2-methyl propanetriol, 2-methyl-1,2,4-butanetriol, trimethylolethane, trimethylolpropane or 1,3,5-trihydroxybenzene.

The acid component constituting the polyester type polymer may, for example, be a benzenedicarboxylic acid such as phthalic acid, isophthalic acid or terephthalic acid, or its anhydride; an alkyl dicarboxylic acid such as succinic acid, adipic acid, sebacic acid or azelaic acid, or its anhydride; an unsaturated dibasic acid such as maleic acid, citraconic acid, itaconic acid, an alkenylsuccinic acid, fumaric acid or mesaconic acid; or an unsaturated dibasic anhydride such as maleic anhydride, citraconic anhydride, itaconic anhydride or an alkenylsuccinic anhydride. Further, a trivalent or higher polyvalent carboxylic acid component may, for example, be trimellitic acid pyromellitic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxypropane, tetra(methylenecarboxy)methane, 1,2,7,8-octane tetracarboxylic acid, embole trimer acid, or an anhydride or partially lower alkyl ester thereof.

In a case where the binder resin is a polyester type polymer, it is preferred that in the molecular weight distribution of the THF-soluble component of the resin component, there is at least one peak in a region of molecular weights of from 3,000 to 50,000, from the viewpoint of the fixing property and offset resistance of the toner. Further, a binder resin is also preferred wherein the THF soluble content contains from 60 to 100 mass % of a component having a molecular weight of at most 100,000. Further preferred is one having at least one peak in a region of molecular weights of from 5,000 to 20,000.

In a case where the binder resin is a polyester type polymer, its acid value is from 0.1 mgKOH/g to 100 mgKOH/g, more preferably from 0.1 mgKOH/g to 70 mgKOH/g, particularly preferably from 0.1 mgKOH/g to 50 mgKOH/g.

In the present invention, the molecular weight distribution of the binder resin is measured by GPC using THF as a solvent.

As a binder resin which may be used for the toner of the present invention, it is also possible to use a resin which contains, in the above-mentioned vinyl polymer component and/or polyester type polymer component, a monomer component reactive with both of such polymer components.

Among monomers constituting the polyester type polymer component, one reactive with a vinyl polymer may, for example, be an unsaturated dicarboxylic acid such as phthalic acid, maleic acid, citraconic acid or itaconic acid, or its anhydride. Among monomers constituting the vinyl polymer component, one reactive with the polyester type polymer may, for example, be a monomer having a carboxyl group or a hydroxyl group, acrylic acid or a methacrylic acid ester.

Further, in a case where a polyester type polymer, a vinyl polymer or another binder resin is used in combination, the binder resin preferably contains at least 60 mass % of a polymer or resin which is capable of bringing the acid value of the entire binder resin to a level within a range of from 0.1 to 50 mgKOH/g.

In the present invention, the acid value of the binder resin component in the toner is obtained by the following method, and the basic operation is in accordance with JIS K-0070.

(1) A sample is used by preliminarily removing additives other than the binder resin (polymer component), or the acid values and contents of components other than the binder resin and crosslinked binder resin, are preliminarily obtained. Then, from 0.5 to 2.0 g of a pulverized product of the sample is accurately weighed, and the weight of the polymer component is designated as W (g). For example, in a case where the acid value of a is binder resin is to be measured from the toner, the acid values and contents of a colorant or magnetic substance, etc. are separately measured, and the acid value of the binder resin is obtained by calculation.

(2) A sample is put into a 300 ml beaker and dissolved by adding 150 ml of a mixed liquid of toluene/ethanol (4/1 by volume ratio).

(3) Using an ethanol solution containing 0.1 mol/L of KOH, titration is carried out by means of a potentiometric titration apparatus.

(4) The amount of the KOH solution used at that time is designated as S (ml), and at the same time, a blank is measured, whereby the amount of the KOH solution used, is designated as B (ml), whereupon the acid value is calculated by the following formula (1). Here, f is a factor of the KOH concentration.

$$\text{Acid value(mgKOH/g)}=[(S-B)\times f\times 5.61]/W \quad (1)$$

From the viewpoint of the storage stability of a toner, the binder resin or the composition containing the binder resin for the toner preferably has a glass transition temperature (Tg) of from 35 to 80° C., particularly preferably from 40 to 75° C. If Tg is lower than 35° C., the toner tends to deteriorate in a high temperature atmosphere, or offset is likely to result at the time of fixing. On the other hand, if Tg exceeds 80° C., the fixing property tends to be low.

A magnetic material useful as a colorant in the present invention may, for example, be (1) a magnetic iron oxide such as magnetite, maghemite or ferrite, or an iron oxide containing other metal oxides; (2) a metal such as iron, cobalt or nickel, or an alloy of such a metal with a metal such as aluminum, cobalt, copper, lead, magnesium, tin, zinc, antimony, beryllium, bismuth, cadmium, calcium, manganese, selenium, titanium, tungsten or vanadium; or (3) a mixture of such (1) and (2).

Specifically, the magnetic material may, for example, be $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder or nickel powder. The above-mentioned magnetic materials may be used alone or in combination as a mixture of two or more of them. A particularly preferred magnetic material is fine powder of tri-iron tetroxide or $\gamma$-di-iron trioxide.

Further, a magnetic iron oxide containing a hetero-element, such as magnetite, maghemite or ferrite, or a mixture thereof may also be used. The hetero-element may, for example, be lithium, beryllium, boron, magnesium, aluminum, silicon, phosphorus, germanium, zirconium, tin, sulfur, calcium, scandium, titanium, vanadium, chromium, manganese, cobalt, nickel, copper, zinc or gallium. A preferred hetero-element may be selected from magnesium, aluminum, silicon, phosphorus and zirconium.

The hetero-element may be taken into the iron oxide crystal lattice or may be contained as an oxide in the iron oxide. Otherwise, it may be present in the form of an oxide or hydroxide on the surface, but is preferably contained as an oxide.

Such a hetero-element may be included as a salt of each hetero-element at the time of forming magnetic particles and may be taken into the magnetic particles by adjusting the pH. Otherwise, it may be precipitated on the surface of the magnetic particles by adjusting the pH after forming the magnetic particles or by adjusting the pH by adding salts of the respective elements.

The amount of such a magnetic material is from 10 to 200 parts by mass, preferably from 20 to 150 parts by mass, of the magnetic material, per 100 parts by mass of the binder resin.

The number average particle size of such magnetic particles is preferably from 0.1 to 2 μm, more preferably from 0.1 to 0.5 μm. The number average particle size can be obtained by measuring a photograph enlarged and taken by a transmission electron microscope, by e.g. a digitizer.

Further, the magnetic material preferably has magnetic properties such that the magnetic properties under application of 10 K oersted are, respectively, a magnetic coercive force of from 20 to 150 oersted, a saturation magnetization of from 50 to 200 emu/g and a residual magnetization of from 2 to 20 emu/g.

The above magnetic material may be used also as a colorant.

As a colorant which may be used in the present invention, in the case of a black toner, a black or blue dye or pigment particles may be mentioned. As such black or blue pigment, carbon black, aniline black, acetylene black, phthalocyanine blue or indanthrene blue may, for example, be used. As a black or blue dye, an azo dye, an anthraquinone dye, a xanthene dye or a methine dye may, for example, be mentioned.

As a colorant which may be used in the case of a color toner, the following ones may be mentioned.

As a magenta colorant, a condensed azo compound, a diketopyrrolopyrrole compound, an anthraquinone compound, a quinacridone compound, a basic dye, a lake dye, a naphthol dye, a benzimidazolone compound, a thioindigo compound or a perylene compound may, for example, be used.

Specifically, a pigment type magenta colorant may, for example, be C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. pigment violet 19, or C.I. vat red 1, 2, 10, 13, 15, 23, 29 or 35.

A pigment may be used alone, but it is preferred to use the above dye and pigment in combination to improve the clearness from the viewpoint of the image quality of a full color image.

A dye type magenta colorant may, for example, be an oil-soluble dye such as C.I. solvent red 1, 3, 8, 23, 24, 25, 27, 30, 49, 81, 82, 83, 84, 100, 109, 121, C.I. disperse red 9, C.I. solvent violet 8, 13, 14, 21, 27, or C.I. disperse violet 1; or a basic dye such as basic red 1, 2, 9, 12, 13, 14, 15, 17, 18, 22, 23, 24, 27, 29, 32, 34, 35, 36, 37, 38, 39, 40, C.I. basic violet 1, 3, 7, 10, 14, 15, 21, 25, 26, 27 or 28.

A cyan colorant may, for example, be a copper phthalocyanine compound or its derivative, anthraquinone, or a basic dye lake compound. Specifically, a pigment type cyan colorant may, for example, be C.I. pigment blue 2, 3, 15, 16, 17, C.I. vat blue 6, C.I. acid blue 45 or a copper phthalocyanine pigment having from 1 to 5 phthalimide methyl groups substituted on the phthalocyanine skeleton.

As an yellow colorant, a condensed azo compound, an isoindoline compound, an anthraquinone compound, an azo metal complex, a methine compound or an allylamide compound may, for example, be used. Specifically, an yellow pigment may, for example, be C.I. pigment yellow 1, 2, 3, 4, 5, 6, 7, 10, 11, 12, 13, 14, 15, 16, 17, 23, 65, 73 or 83, or C.I. vat yellow 1, 3 or 20.

The colorant is used in an amount of from 0.1 to 20 parts by mass, preferably from 5 to 10 parts by mass, per 100 parts by mass of the binder resin.

The toner of the present invention may be mixed with a carrier and used as a two component developer. The carrier to be used in the present invention is a carrier such as usual ferrite or magnetite, or a resin-coated carrier.

The resin-coated carrier comprises carrier core particles and a coating material as a resin to coat the surface of the carrier core particles. The resin to be used as such a coating material may, for example, be a styrene/acrylate type resin such as a styrene/acrylate copolymer or a styrene/methacrylate copolymer; an acrylate type resin such as an acrylate copolymer or a methacrylate copolymer; a fluororesin such as polytetrafluoroethylene, monochlorotrifluoroethylene polymer or polyvinylidene fluoride; a silicone resin, a polyester resin, a polyamide resin, a polyvinyl butyral or an amino acrylate resin. Further, any resin which may be used as a material to coat a carrier, such as an ionomonomer resin or polyphenylene sulfide resin may be used. These resins may be used alone or in combination as a mixture of a plurality of them.

Otherwise, a binder type carrier/core having a magnetic powder dispersed in a resin may also be used.

In a resin-coated carrier, as a method for coating the surface of carrier cores with at least resin coating material, it is possible to apply a method of applying the resin as dissolved or suspended in a solvent to let it deposit on the carrier cores, or a method of simply mixing in a powder state. The proportion of the resin coating material to the resin-coated carrier may suitably be determined, but it is preferably from 0.01 to 5 mass %, more preferably from 0.1 to 1 mass %, to the resin-coated carrier.

As an example for coating magnetic particles with a mixture of two or more coating materials, (1) one treated with 12 parts by mass of a mixture of dimethyldichlorosilane and dimethylsilicone oil (1:5 by weight ratio), per 100 parts by mass of fine powder of titanium oxide, or (2) one treated with 20 parts by mass of a mixture of dimethyldichlorosilane and dimethylsilicone oil (1:5 by mass ratio), per 100 parts by mass of fine powder of silica, may be mentioned.

Among resins as resin coating materials, a styrene/methyl methacrylate copolymer, a mixture of a fluororesin and a styrene type copolymer, or a silicone resin is preferred, and a silicone resin is particularly preferred.

A mixture of a fluororesin and a styrene type copolymer may, for example, be a mixture of polyvinylidene fluoride and a styrene/methyl methacrylate copolymer, a mixture of polytetrafluoroethylene and a styrene/methyl methacrylate copolymer, or a mixture of a vinylidene fluoride/tetrafluoroethylene copolymer (from 10:90 to 90:10 by copolymer mass ratio), a styrene/2-ethylhexyl acrylate copolymer (from 10:90 to 90:10 by copolymer mass ratio), and a styrene/2-ethylhexyl acrylate/methyl methacrylate copolymer (20-60:5-30:10-50 by copolymer mass ratio).

The silicone resin may, for example, be a nitrogen-containing silicone resin, or a modified silicone resin formed by reacting a silicone resin with a nitrogen-containing silane coupling agent.

As the magnetic material for the carrier core, an oxide such as ferrite, an iron-excessive type ferrite, magnetite or γ-iron oxide; a metal such as cobalt or nickel; or an alloy thereof may be employed. Further, elements contained in such a magnetic material may, for example, be iron, cobalt, nickel, aluminum, copper, lead, magnesium, tin, zinc, antimony, beryllium, bismuth, calcium, manganese, selenium, titanium, tungsten and vanadium. Preferred is a copper/zinc/iron ferrite containing copper, zinc and iron components as the main components, or a manganese/magnesium/iron ferrite containing manganese, magnesium and iron components as the main components.

The electrical resistance of the carrier is preferably made to be from $10^6$ to $10^{10}$ Ω·cm by adjusting the surface roughness of the carrier or the amount of the coating resin. The average particle size of the carrier is usually from 4 to 200 μm, preferably from 10 to 150 μm, more preferably from 20 to 100 μm. Especially, the resin-coated carrier preferably has a 50% average particle size of from 20 to 70 μm.

In a two component developer, it is preferred to use from 1 to 200 parts by mass, more preferably from 2 to 50 parts by mass, of the toner of the present invention, per 100 parts by mass of the carrier.

The toner of the present invention may further contain a wax. As the wax to be used in the present invention, the following may be mentioned. For example, an aliphatic hydrocarbon wax such as polyolefin wax, microcrystalline wax, paraffin wax or sazole wax; an oxide of an aliphatic hydrocarbon wax such as oxidized polyethylene wax, or a block copolymer thereof; a plant wax such as candelia wax, carnauba wax, Japan wax or jojoba wax; an animal wax such as bees wax, lanolin or spermaceti wax; a mineral wax such as ozokerite, ceresin or petrolatum; a wax containing fatty acid ester as a main component, such as montanic acid ester wax or castor wax; or one having a part or whole of a fatty acid ester deoxidized, such as deoxidized carnauba wax, may, for example, be mentioned.

Examples of the wax may further be a saturated straight chain fatty acid such as palmitic acid, stearic acid, montanic acid or a straight chain alkylcarboxylic acid having a straight chain alkyl group; an unsaturated fatty acid such as plandinic acid, eleostearic acid or valinaric acid; a saturated alcohol such as stearyl alcohol, eicosyl alcohol, behenyl alcohol, carnaupyl alcohol, ceryl alcohol, mesilyl alcohol or a long chain alkyl alcohol; a polyhydric alcohol such as sorbitol; a fatty acid amide such as linolic acid amide, olefinic acid amide or lauric acid amide; a saturated fatty acid bisamide such as methylenebiscapric acid amide, ethylenebislauric acid amide or hexamethylenebisstearic acid amide; an unsaturated fatty acid amide such as ethylenebisoleic acid amide, hexamethylenebisoleic acid amide, N,N'-dioleyladipic acid amide or N,N'-dioleylsebacic acid amide; an aromatic bisamide such as m-xylenebisstearic acid amide or N,N'-distearyl isophthalic acid amide; a fatty acid metal salt such as calcium stearate, calcium laurate, zinc stearate or magnesium stearate; a wax having a vinyl monomer such as styrene or acrylate grafted to an aliphatic hydrocarbon wax; a partial ester compound of a fatty acid with a polyhydric alcohol, such as behenic acid monoglyceride; and a methylester compound having a hydroxyl group obtainable by hydrogenating a plant oil and fat.

A wax to be preferably employed may, for example, be a polyolefin obtained by radical polymerization of an olefin under high pressure; a polyolefin obtained by purifying a low molecular weight byproduct obtainable during the polymerization of a high molecular weight polyolefin; a polyolefin polymerized under reduced pressure by means of a catalyst such as a Ziegler catalyst or a metallocene catalyst; a polyolefin polymerized by means of radiation, electromagnetic waves or light; a low molecular weight polyolefin obtained by thermal decomposition of a high molecular weight polyolefin; a paraffin wax; a microcrystalline wax; Fischer-Tropsch wax; a synthetic hydrocarbon wax prepared by e.g. a synthol method, a hydrochol method or an Arge process; a synthetic wax prepared by using a compound having one carbon atom as a monomer; a hydrocarbon type wax having a functional group such as a hydroxyl group or a carboxyl group; a mixture of a hydrocarbon type wax and a hydrocarbon type wax having a functional group; a wax having such a wax as a matrix graft-modified with a vinyl monomer such as styrene, a maleate, an acrylate, a methacrylate or maleic anhydride.

Further, one having the molecular weight distribution of such a wax made sharp by means of a press sweating method, a solvent method, a recrystallization method, a vacuum distillation method, a supercritical gas extraction method or a solution precipitation method, or one obtained by removing from such a wax a low molecular weight solid fatty acid, a low molecular weight solid alcohol, a low molecular weight solid compound and other impurities, may be preferably employed.

The wax to be used in the present invention preferably has a melting point of from 70 to 140° C., further preferably from 70 to 120° C., to take a balance of the fixing property and offset resistance. If the melting point is lower than 70° C., the blocking resistance tends to be low, and if it exceeds 140° C., the effect for offset resistance tends to be hardly obtainable.

Further, by using two or more different types of waxes in combination, it is possible to simultaneously obtain a plasticizing action and release action as actions of the waxes.

A wax having a plasticizing action may, for example, be a wax having a low melting point or one having a branch or a polar group in its molecular structure. A wax having a release action may, for example, be a wax having a high melting point or one having a straight chain structure or non-polar one having no functional group in its molecular structure. As a practical example, a combination of two or more different waxes having a difference in melting point of from 10° C. to 100° C., or a combination of a polyolefin and a graft-modified polyolefin may, for example, be mentioned.

In a case where two types of waxes having similar structures are selected, a wax having a relatively low melting point exhibits a plasticizing action, and a wax having a high melting point exhibits a release action. When the difference in melting point of two types of waxes selected is from 10 to 100° C., the functional separation is effectively attained. If the difference is less than 10° C., the functional separation effect tends to be hardly obtainable, and if it exceeds 100° C., enhancement of the functions due to the mutual action tends to be hardly obtainable. In such a case, the melting point of at least one wax is preferably from 70 to 120° C., further preferably from 70 to 100° C., whereby the functional separation effect tends to be readily obtainable.

Further, a wax is relatively such that one having a branched structure, one having a polar group such as a functional group or one modified with a component different from the main component exhibits a plasticizing action, and one having a straighter chain structure, a non-polar one having no functional group or a non-modified straight one exhibits a release action.

A preferred combination may, for example, be a combination of a polyethylene homopolymer or copolymer containing ethylene as the main component, and a polyolefin homopolymer or copolymer containing an olefin other than ethylene, as the main component; a combination of a polyolefin and a graft-modified polyolefin; a combination of an alcohol wax, fatty acid wax or ester wax, and a hydrocarbon wax; a combination of Fischer-Tropsch wax or polyolefin wax, and a paraffin wax or microcrystalline wax; a combination of Fischer-Tropsch wax and a polyolefin wax; a combination of a paraffin wax and a microcrystalline wax; or a combination of Carnauba wax, candelilla wax, rice wax or montan wax, and a hydrocarbon wax.

In any case, it is preferred that among endothermic peaks observed by DSC (differential scanning calorimetry) of a toner, the peak top temperature of the maximum peak is present in a region of from 70 to 110° C., and it is more preferred that the maximum peak is within a range of from 70 to 110° C. It is thereby easy to take a balance of the storage stability and the fixing property of the toner.

In the toner of the present invention, the total content of these waxes is preferably from 0.2 to 20 parts by mass, more preferably from 0.5 to 10 parts by mass, per 100 parts by mass of the binder resin, to be effective.

In the present invention, the melting point of a wax is determined to be a temperature at the peak top of the maximum peak among endothermic peaks of the wax measured in DSC.

In DSC of a wax or a toner in the present invention, it is preferred to carry out the measurement by a high precision inner heat input compensatory differential scanning calorimeter. The measuring method is carried out in accordance with ASTM D3418-82.

As a DSC curve to be used in the present invention, a DSC curve measured at the time of raising the temperature at a temperature raising rate of 10° C./min after taking a prehistory by once raising and lowering the temperature, is used.

To the toner of the present invention, a flowability-improving agent may be added. The flowability-improving agent is one to improve (facilitate) the flowability of the toner by adding it to the toner surface. For example, carbon black, fluororesin powder such as vinylidene fluoride fine powder or polytetrafluoroethylene fine powder, fine powder silica such as silica prepared by a wet system or silica prepared by a dry system, fine powder titanium oxide, fine powder alumina, or treated silica, treated titanium oxide or treated alumina having surface treatment applied with a silane coupling agent, a titanium coupling agent or silicone oil, may be mentioned. Among them, fine powder silica, fine powder titanium oxide or fine powder alumina is preferred. Further, treated silica having surface treatment applied with a silane coupling agent or silicone oil, is further preferred. The particle size of the flowability-improving agent is preferably from 0.001 to 2 μm, particularly preferably from 0.002 to 0.2 μm, as an average primary particle size.

The preferred fine powder silica is a fine powder formed by gas-phase oxidation of a silicon halide compound, and it is so-called dry system silica or fumed silica.

Commercially available silica fine powders produced by gas phase oxidation of silicon halide compounds may, for example, be ones sold under the following tradenames. AEROSIL (manufactured by Nippon Aerosil Co., Ltd., the same applies hereinafter)-130, -300, -380, -TT600, -MOX170, -MOX80 or -COK84; Ca-O-SiL (manufactured by CABOT, the same applies hereinafter)-M-5, -MS-7, -MS-75, -HS-5 or -EH-5; Wacker HDK (manufactured by WACKER-CHEMIE GMBH, the same applies thereinafter)-N20V15, -N20E, -T30 or T40; D-CFineSilica (manufactured by Dow Corning); Fransol (manufactured by Fransil), etc.

Further, more preferred is treated silica fine powder obtained by subjecting silica fine powder formed by gas phase oxidation of a silicon halide compound, to hydrophobic treatment. As such treated silica fine powder, one having silica fine powder treated so that the hydrophobicity measured by a methanol titration test will show a value of preferably from 30 to 80%, is preferred. The hydrophobicity will be imparted by chemically or physically treating silica fine powder with an organic silicon compound reactive with or physically adsorbing the silica fine powder. A preferred method is a method wherein silica fine powder formed by gas phase oxidation of a silicon halide compound is surface-treated with an organic silicon compound.

The organic silicon compound may, for example, be hydroxypropyl trimethoxysilane, phenyl trimethoxysilane, n-hexadecyl trimethoxysilane, n-octadecyl trimethoxysilane, vinyl methoxysilane, vinyl triethoxysilane, vinyl triacetoxysilane, dimethylvinyl chlorosilane, divinyl chlorosilane, γ-methacryloxypropyl trimethoxysilane, hexamethyldisilane, trimethylsilane, trimethylchlorosilane, dimethyldichlorosilane, methyltrichlorosilane, allyldimethyl chlorosilane, allylphenyl dichlorosilane, benzyldimethyl chlorosilane, bromomethyldimethyl chlorosilane, α-chloroethyl trichlorosilane, β-chloroethyl trichlorosilane, chloromethyldimethyl chlorosilane, triorganosilylmercaptan, trimethylsilylmercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane or a dimethylpolysiloxane having from 2 to 12 siloxane units per molecule and containing from 0 to 1 hydroxyl group bonded to Si in a unit located at the terminal. Further, silicone oil such as dimethylsilicone oil may be mentioned. They may be used alone or in combination as a mixture of two or more of them.

The flowability improving agent has a number average particle diameter of from 5 to 100 nm, preferably from 5 to 50 nm and a specific surface area of preferably at least 30 $m^2/g$, more preferably from 60 to 400 $m^2/g$, by nitrogen absorption as measured by BET method.

As the fine powder of the surface-treated flowability-improving agent, the specific surface area is preferably at least 20 $m^2/g$, particularly preferably from 40 to 300 $m^2/g$. Such a fine powder of the flowability-improving agent is used in an amount of from 0.03 to 8 parts by mass, preferably from 0.5 to 5 parts by mass, per 100 parts by mass of the toner particles.

The toner of the present invention may further contain other additives such as various metal soaps, a fluorine type surfactant, dioctyl phthalate etc., in order to protect a photosensitive material and a carrier, to improve a cleaning property, to adjust thermal, electric or physical properties, to adjust a resistance, to adjust a softening point, to improve a fixing rate, etc., and may further include an electroconductivity-imparting agent such as tin oxide, zinc oxide, carbon black and antimony oxide, and inorganic fine powders such as titanium oxide, aluminum oxide and alumina, as the case requires. Also, these inorganic fine powders may be optionally subjected to hydrophobic treatment.

Also, the toner may further contain a lubricant such as polytetrafluoroethylene, zinc stearate or vinylidene polyfluoride, an abradant such as cesium oxide, silicone carbide or strontium titanate, an anti-caking agent, and a development-improving agent such as black fine particles and white fine particles having a reverse polarity to the toner particles, in a small amount.

In order to control the electrostatic charge, these additives are preferably treated with various treating agents including a silicone varnish, various modified silicone varnishes, a silicone oil, various modified silicone oils, a silane coupling agent, a silane coupling agent having a functional group, and other organic silicone compounds.

Together with the above-mentioned additives and toner, the charge control agent of the present invention is thoroughly mixed and stirred by a mixer such as a HENSCHEL mixer, a ball mill or the like to have the surface of toner particles uniformly treated with the above additives, thereby obtaining a desired electrostatic image developing toner.

The toner of the present invention is thermally stable and can retain a stable chargeability without being susceptive to a thermal change during an electrophotographic process.

Also, since it is uniformly dispersed in any binder resin, the electrostatic charge distribution of a fresh toner becomes very uniform, and the toner of the present invention including untransferred and recovered toner (used toner) shows no substantial change in a saturated tribo-charged amount and a charge distribution as compared with a fresh toner.

When a used toner provided from the electrostatic image developing toner of the present invention is to be reused, it is possible to further make the difference between the fresh toner and the used toner smaller by preparing a toner using a polyester resin including an aliphatic diol as a binder resin or a metal-crosslinked styrene-acryl copolymer as a binder resin and also using a large amount of polyolefin added thereto.

As a method for producing the toner of the present invention, a known method may be used. For example, it is preferred to use a method wherein the above-described materials to constitute a toner, such as the binder resin, charge control agent composition, colorant, etc., are thoroughly mixed by a mixing machine such as a ball mill, and the mixture is then thoroughly kneaded by a heat-kneading apparatus such as a heat roll kneader and then cooled, solidified, pulverized and then classified (pulverization method).

Otherwise, the toner of the present invention may be produced by a method wherein the above mixture is dissolved in a solvent, followed by spraying to form fine particles, which are then dried and classified.

Further, the toner may be produced also by a polymerization method wherein to a monomer to constitute a binder resin, prescribed materials are mixed to form an emulsion or suspension, followed by polymerization to obtain a toner, or a method wherein prescribed materials are incorporated to a core material, a shell material or is both of them in a so-called microcapsule toner comprising the core material and the shell material.

Further, the toner of the present invention may be produced by thoroughly mixing toner particles with optional additives by a mixing machine such as HENSCHEL mixer.

The method for producing the toner of the present invention by the above-mentioned pulverization method will be described in further detail.

First, a binder resin, a colorant, a charge control agent composition and other necessary additives are uniformly mixed. Such mixing may be carried out by using a known mixer, such as a HENSCHEL mixer, a supermixer or a ball mill. The obtained mixture is heat-melted and kneaded by means of a closed type kneader or a single screw or twin screw extruder. After cooling the kneaded product, it is roughly crushed by means of crusher or a hammer mill and further pulverized by a pulverizer such as a jet mill, a high speed rotor mill. Further, classification is carried out to a prescribed particle size by using an air classification machine such as an elbow jet of an inertial classification system utilizing the Coanda effect, a microplex of a cyclone (centrifugal) classification system or a DS separator. In a case where the toner surface is treated with an external additive or the like, the toner and such an external additive are mixed and stirred by a high speed mixer such as a HENSCHEL mixer or a supermixer.

Further, the toner of the present invention can be produced by a suspension polymerization method or an emulsion polymerization method.

In the suspension polymerization method, a polymerizable monomer, a colorant, a polymerization initiator, a charge control agent composition, and, if necessary, a crosslinking agent or other additives, are uniformly dissolved or dispersed to prepare a monomer composition. Then, this monomer composition and a dispersion stabilizer are dispersed in a continuous phase e.g. an aqueous phase by means of a suitable mixing or dispersing machine, such as a homomixer, a homogenizer, an atomizer, a microfluidizer, a one component fluid nozzle, a gas-liquid fluid nozzle or an electric emulsifier. Preferably, the stirring speed, temperature and time are adjusted for granulation so that droplets of the monomer composition will have a desired toner particle size. At the same time, the polymerization reaction is carried out at a temperature of from 40 to 90° C. to obtain toner particles having a desired particle size. The obtained toner particles are washed and collected by filtration and then dried. For treatment with an external additive after the production of toner particles, the method as described above may be used.

If the production is carried out by an emulsion polymerization method, the particles will be excellent in uniformity as compared with the particles obtained by the above-described suspension polymerization method, but the average particle size is very small at a level of from 0.1 to 1.0 μm, and in some cases, seed polymerization may be carried out by using emulsified particles as nuclei and the particles are grown by adding the polymerizable monomer, or a method may be used wherein emulsified particles are joined and fused to a suitable average particle size.

The production of a toner by such a polymerization method involves no pulverization step. Therefore, it is not required to impart brittleness to the toner particles, and it is possible to use a low softening point material in a large amount which used to be difficult to use in the conventional pulverization method, whereby the choice of a material will be broadened. Further, a release agent or colorant as a hydrophobic material is less likely to be exposed on the surface of the toner particles, whereby it is possible to minimize soiling of the toner-carrier component, photoreceptor, transfer roller or fixing device.

By producing the toner of the present invention by such a polymerization method, it is possible to further improve the properties such as the image reproducibility, transfer property, color reproducibility, etc., and it is possible to reduce the particle size of the toner to meet the requirement for fine dots thereby to obtain a toner having a sharp particle size distribution relatively easily.

As a polymerizable monomer to be used for the production of the toner of the present invention by a polymerization method, a vinyl type polymerizable monomer capable of radical polymerization may be used. As such a vinyl type polymerizable monomer, a monofunctional polymerizable monomer or a polyfunctional polymerizable monomer may be used.

The monofunctional polymerizable monomer may, for example, be a styrene type polymerizable monomer such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene or p-phenylstyrene; an acrylate type polymerizable monomer such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, benzyl acrylate, dimethyl phosphate methyl acrylate, dibutyl phosphate ethyl acrylate or 2-benzoyloxyethyl acrylate; a methacrylate type polymerizable monomer such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, diethyl phosphate methacrylate or dibutyl phosphate ethyl acrylate; an unsaturated fatty acid monocarboxylic acid ester; a vinyl ester such as vinyl acetate, vinyl propionate or vinyl benzoate; a vinyl ether such as vinyl methyl ether or vinyl isobutyl ether; or a vinyl ketone such as vinyl methyl ketone, vinyl hexyl ketone or vinyl isopropyl ketone.

The polyfunctional polymerizable monomer may, for example, be diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2-bis[4-(acryloxydiethoxy)phenyl]propane, trimethylolpropane triacrylate, tetramethylolmethane tetraacrylate, ethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol methacrylate, polypropylene glycol dimethacrylate, 2,2-bis[4-(methacryloxydiethoxy)phenyl]propane, 2,2-bis[4-(metharyloxypolyethoxy)phenyl]propane, trimethylolpropane trimethacrylate, tetramethylolmethane tetramethacrylate, divinylbenzene, divinylnaphthalene or divinyl ether.

In the present invention, it is possible to use the above monofunctional polymerizable monomer alone or in combination of two or more of such monomers, or such a monofunctional polymerizable monomer and a polyfunctional polymerizable monomer in combination. Further, the above polyfunctional polymerizable monomer may be used as a crosslinking agent.

As a polymerization initiator to be used at the time of polymerization of the above polymerizable monomer, an oil-soluble initiator and/or a water-soluble initiator may be used. For example, the oil-soluble initiator may, for example, be an azo compound such as 2,2'-azobisisobutyronitrile, 2,2'-azobis-2,4-dimethylvaleronitrile, 1,1'-azobis(cyclohexane-1-carbonitrile) or 2,2'-azobis-4-methoxy-2,4-dimethylvaleronitrile; or a peroxide initiator such as acetylcyclohexylsulfonyl peroxide, diisopropyl peroxycarbonate, decanonyl peroxycarbonate, decanonyl peroxide, propionyl peroxide, acetyl peroxide, tert-butyl peroxy-2-ethyl hexanoate, benzoyl peroxide, tert-butyl peroxyisobutyrate, cyclohexanone peroxide, methyl ethyl ketone peroxide, tert-butyl peroxide, di-tert-butyl peroxide or cumene hydroperoxide.

The water-soluble initiator to be used at the time of producing the toner of the present invention by a polymerization method, may, for example, be ammonium persulfate, potassium persulfate, 2,2'-azobis(N,N'-dimethyleneisobutyroamidine)hydrochloride, 2,2'-azobis(2-aminodipropane)hydrochloride, azobis(isobutylamidine)hydrochloride, sodium 2,2'-azobisisobutyronitrile sulfonate, ferrous sulfate or hydrogen peroxide.

The polymerization initiator is added in an amount of from 0.5 to 20 parts by mass, preferably from 1 to 10 parts by mass, per 100 parts by mass of the polymerizable monomer, and such initiators may be used alone or in combination as a mixture. As a dispersant to be used at the time of producing the polymerized toner, an inorganic oxide such as tricalcium phosphate, magnesium phosphate, aluminum phosphate, zinc phosphate, calcium carbonate, magnesium carbonate, aluminum hydroxide, calcium metasilicate, calcium sulfate, barium sulfate, bentonite, silica or alumina, or an organic compound such as polyvinyl alcohol, gelatin, methyl cellulose, methylhydroxypropyl cellulose, ethyl cellulose, a sodium salt of carboxymethyl cellulose, or starch, may, for example, be used. Such a dispersant is used in an amount of from 0.2 to 2 parts by mass, preferably from 0.5 to 1 part by mass, per 100 parts by mass of the polymerizable monomer.

As such a dispersant, a commercial product may be used as it is. However, in order to obtain dispersed particles having a fine uniform particle size, such an inorganic compound may be formed in a dispersing medium with stirring at a high speed.

As compared with a toner obtained by a pulverization method and having no special treatment applied, a toner obtainable by the above-described polymerization method tends to have a small irregularity degree of toner particles, and the toner has irregular shapes, whereby the contact area between the electrostatic image carrier and the toner increases so that the adhesive force of the toner increases, and as a result, contamination in the machine tends to be less, and a higher image density and an image having a higher quality will be readily obtainable.

Also with the toner by the pulverization method, it is possible to reduce the degree of irregularities on the toner surface by a hot water bath method of heating toner particles as dispersed in water, a heat treating method of passing them in a hot air stream or a mechanical impact method of treating them by imparting a mechanical energy.

An apparatus effective to reduce the degree of irregularities may, for example, be a mechanofusion system employing a dry mechanochemical method (manufactured by Hosokawa Micron Ltd.), an I system jet mill, a hybridizer (manufactured by Nara Machinery Co., Ltd.) which is a mixing apparatus having a rotor and a liner, or a HENSCHEL mixer which is a mixing machine having high speed stirring vanes.

It is possible to use an average degree of circularity as one of values representing the degree of irregularities of toner particles. The average degree of circularity (C) means a value obtained in such a manner that the degree of circularity (Ci) is obtained by the following formula (2), and further, as shown by the following formula (3), the sum of the degrees of circularity of all particles measured is divided by the total number (m) of particles measured.

$$\text{Degree of circularity}(Ci)=\text{Circumferential length of a circle having the same projected surface area as a particle/Circumferential length of the projected image of a particle} \quad (2)$$

$$\text{Average degree of circularity}(C)=\sum_{i=1}^{m} Ci/m \quad (3)$$

The above degree of circularity (Ci) is measured by using a flow type particle image analyzer (e.g. FPIA-1000, manufactured by Toa Medical Electronics). The measuring method is such that about 5 mg of a toner is dispersed in 10 ml of water having about 0.1 mg of a nonionic surfactant dissolved therein, to prepare a dispersion, and the dispersion is irradiated with ultrasonic waves (20 kHz, 50 W) for 5 minutes to bring the concentration of the dispersion to from 5,000 to 20,000 particles/μL, whereupon by using the above-mentioned flow type particle image analyzer, the circularity degree distribution of particles having diameters corresponding to circles of at is least 0.60 μm and less than 159.21 μm is measured.

The value of the average degree of circularity is preferably from 0.955 to 0.990, more preferably from 0.960 to 0.985. When the average degree of circularity of the toner particles is adjusted to be within this range, it is possible to minimize a phenomenon of leading to an increase of the residual toner in transferring thereby to prevent retransfer.

In the case of the toner of the present invention, from the viewpoint of the image quality and the productivity of the toner, the particle size of the toner is preferably from 2 to 15 μm, more preferably from 3 to 12 μm, as a volume base average particle size, in the measurement using a laser type particle size distribution measuring machine such as Micron Sizer (e.g. manufactured by Seishin Enterprise Co., Ltd.). If the average particle size exceeds 15 μm, the resolution or sharpness tends to deteriorate, and if the average particle size is less than 2 μm, the resolution may be good, but there will be a problem of a high cost due to deterioration in the yield during the production of the toner, scattering of the toner in the machine or a trouble to health such as penetration into the skin.

In the case of the toner of the present invention, the content of particles of 2 μm or smaller is preferably is from 10 to 90%, based on the number of particles, and the content of particles of 12.7 μm or larger is preferably from 0 to 30% based on the volume of particles, by the particle size measurement by means of e.g. COULTER COUNTER (TA-II, manufactured by COULTER).

In the case of the electrostatic developing toner of the present invention, the specific surface area of the toner is preferably from 1.2 to 5.0 $m^2/g$, more preferably from 1.5 to 3.0 $m^2/g$, in the measurement of the specific surface area by BET using nitrogen as the gas for adsorption and desorption.

The measurement of the specific surface area is carried out for example by using a BET specific surface area measuring apparatus (e.g. FLowSorb II 2300, manufactured by Shimadzu Corporation) in such a manner that adsorbed gas on the surface of the toner is released at 5° C. for 30 minutes, followed by quenching with liquid nitrogen to let nitrogen gas be again adsorbed, and then the temperature is raised again to 50° C., and the specific surface area is defined to be a value obtained from the amount of the gas desorbed at that time.

In the case of the toner of the present invention, the apparent specific gravity (bulk density) is measured by using e.g. a powder tester (e.g. one manufactured by Hosokawa Micron Corporation). In the case of a nonmagnetic toner, it is preferably from 0.2 to 0.6 $g/cm^3$, and in the case of a magnetic toner, it is preferably from 0.2 to 2.0 $g/cm^3$ although it may depend on the type or content of the magnetic powder.

In the case of the toner of the present invention, the true specific gravity in the case of a nonmagnetic toner is preferably from 0.9 to 1.2 $g/cm^3$, and the true specific gravity in the case of a magnetic toner is preferably from 0.9 to 4.0 $g/cm^3$, although it may depend on the type or content of the magnetic powder.

The true specific gravity of a toner will be calculated as follows. 1,000 g of the toner is accurately weighed, put into a tablet-forming container having a diameter of 10 mm and compression-molded under vacuum by exerting a pressure of 200 $kgf/cm^2$. The height of this cylindrical molded product is measured by a micrometer, whereby the true specific gravity is calculated.

The fluidity of a toner is defined by a flow angle of repose and a static angle of repose measured, for example, by a repose angle-measuring apparatus (e.g. one manufactured by Tsutsui Rika K.K.). The electrostatic image developing toner using a charge control agent of the present invention preferably has a flow angle of repose of from 5° to 45° and a static angle of repose of from 10° to 50°.

In the case of a pulverized type toner, the toner of the present invention should preferably have an average value of shape coefficient (SF-1) of from 100 to 400 and an average value of shape coefficient (SF-2) of from 100 to 350.

In the present invention, shape coefficients SF-1 and SF-2 of a toner are calculated by sampling a group of about 30 toner particles as an image enlarged 1,000 times in one view by e.g. an optical microscope (such as BH-2, manufactured by Olympus Optical Co., Ltd.) equipped with a CCD camera, transferring the obtained image to an image analyzing apparatus (such as Luzex FS® manufactured by Nireko K.K.), and repeating the same operation until measuring about 1,000 particles of the toner, whereupon the shape coefficients are calculated. Shape coefficients SF-1 and SF-2 are calculated by the following formulae:

$$SF\text{-}1=((ML^2\times\pi)/4A)\times 100$$

(In the above formula, ML is the maximum length (μm) of a particle and A is the projected area ($\mu m^2$) of one particle).

$$SF\text{-}2=(PM^2/4A\pi)\times 100$$

(In the above formula, PM is the circumference length (μm) of a particle and A is the projected area ($\mu m^2$) of one particle).

SF-1 expresses a strain of a particle, and if a particle becomes closer to a sphere, the SF-1 value becomes closer to 100, and if this value becomes larger, a particle becomes longer and narrower. On the other hand, SF-2 expresses an irregularity degree of a particle surface, and if a particle becomes closer to a sphere, the SF-2 value becomes closer to 100, and if a particle shape becomes more complicated, the SF-2 value becomes larger.

The toner of the present invention preferably has a volume resistivity of from $1\times10^{12}$ to $1\times10^{16}$ Ω·cm in the case of a non-magnetic toner and has a volume resistivity of from $1\times10^{8}$ to $1\times10^{16}$ Ω·cm in the case of a magnetic toner although it varies depending on the content or type of a magnetic powder used. The volume resistivity of the toner is measured by compression-molding toner particles into a disk-like test piece having a diameter of 50 mm and a thickness of 2 mm, fixing the test piece on an electrode for solid (e.g. SE-70 manufactured by Ando Denki K.K.), and measuring a resistance value one hour after continuously applying a direct current voltage of 100 V by using a high insulating resistance meter (e.g. 4339A manufactured by Hughlet Packard Co.).

The toner of the present invention preferably has a dielectric dissipation factor of from $1.0\times10^{-3}$ to $15.0\times10^{-3}$ in the case of a non-magnetic toner and has a dielectric dissipation factor of from $2\times10^{-3}$ to $30\times10^{-3}$ in the case of a magnetic toner although it varies depending on the content or kind of a magnetic powder used. The volume resistivity of the toner is measured by compression-molding toner particles into a disk-like test piece having a diameter of 50 mm and a thickness of 2 mm, fixing the test piece on an electrode for solid, and measuring a dielectric dissipation factor (Tan δ) value obtained by applying a frequency of 1 KHz and a peak to peak voltage of 0.1 KV by using a LCR meter (e.g. 4284A manufactured by Hughlet Packard Co.).

The toner of the present invention preferably has an Izod impact strength of from 0.1 to 30 kg·cm/cm. The Izod impact strength of the toner is measured by subjecting a plate-like test piece prepared by heat-melting toner particles to a test of JIS standard K-7110 (impact strength test method of rigid plastic).

The toner of the present invention preferably has a melt index (MI value) of from 10 to 150 g/10 min. The melt index (MI value) of the toner is measured at a temperature of 125° C. under a load of 10 kg in accordance with JIS standard K-7210 (A method).

The toner of the present invention preferably has a melting-initiating temperature in a range of from 80 to 180° C., and also has a 4 mm-descending temperature in a range of from 90 to 220° C. The melt-initiating temperature of the toner is measured by compression-molding toner particles into a cylindrical test piece having a diameter of 10 mm and a thickness of 20 mm, setting the test piece in a heat-melting property-measuring apparatus, e.g. a flow tester (e.g. CFT-500C manufactured by Shimadzu Corporation) and measuring a temperature value, at which melting starts and a piston begins to descend under a load of 20 kgf/cm$^2$. The 4 mm descending temperature of the toner is measured by measuring a temperature value, at which a piston descends 4 mm in the same test as above.

The toner of the present invention preferably has a glass transition temperature (Tg) of from 35 to 80° C., more preferably of from 40 to 75° C. The glass transition temperature of the toner is measured from a peak value of a phase change appeared when raising the temperature at a constant rate, then rapidly cooling and raising the temperature again by using a differential thermogravimetry apparatus (DSC). When the Tg value of the toner is lower than 35° C., the offset resistance and storage stability become poor and when the Tg value exceeds 80° C., the fixing strength of an image tends to be low.

With respect to the heat absorption peaks observed in DSC of the toner of the present invention, it is preferred that the peak top temperature of the maximum peak is present in a region of from 70 to 120° C.

The toner of the present invention preferably has a melt viscosity of from 1,000 to 50,000 poises, more preferably from 1,500 to 38,000 poises. Here, the melt viscosity of the toner is measured by compression-molding toner particles into a cylindrical test piece having a diameter of 10 mm and a thickness of 20 mm, setting the test piece in a heat melt property-measuring apparatus, e.g. a flow tester (CFT-50° C., manufactured by Shimadzu Corporation), and measuring the melt viscosity under a load of 20 kgf/cm$^2$.

The solvent insoluble residue of the toner of the present invention is preferably such that the TFH insoluble content is from 0 to 30 mass %, the ethyl acetate insoluble content is from 0 to 40 mass %, and the chloroform insoluble content is from 0 to 30 mass %. Here, the solvent insoluble residue is a value obtained in such a manner that 1 g of a toner is uniformly dissolved or dispersed in 100 ml of each solvent of THF, ethyl acetate and chloroform, such a solution or dispersion is subjected to pressure filtration, the filtrate is dried and quantified, and from the obtained value, the proportion of insolubles in the organic solvent, in the toner, is calculated.

The toner of the present invention may be used in a one-component developing system which is one of image-forming methods. The one-component developing system is a system for developing a latent image by supplying a toner formed into a thin film to a latent image support. Forming of the toner into a thin film is usually carried out by using an apparatus comprising a toner-transporting member, a toner layer-thickness regulating member and a toner-supply-assisting member, wherein the toner supply-assisting member and the toner-transporting member, and the toner layer thickness-regulating member and the toner-transporting member, are in contact with each other, respectively.

Now, a case wherein the toner of the present invention is used for a two-component developing system, will be described in detail.

The two-component developing system is a system of using a toner and a carrier (one having a roll as an electrostatic charge-imparting material and a toner-transporting material), wherein as the carrier, the above-mentioned magnetic material or glass beads may be used.

The developer (the toner and the carrier) is stirred by a stirring member to generate a predetermined electrostatic charge and then transferred by e.g. a magnet roller to a development site. On the magnet roller, the developer is held on the roller surface by a magnetic force to form a magnetic brush having its layer regulated to a proper height by e.g. a developer-regulating plate. As the developer roller rotates, the developer moves on the roller to be in contact with an electrostatic latent image holder or to face it in a non-contact state at a predetermined distance, whereby the latent image is developed into a visible image. In the case of development in a non-contact state, it is usually possible to obtain a driving force for flying the toner in a space of a predetermined distance by letting a direct current electric field between the developer and the latent image holder, but in order to develop a clearer image, it is also possible to use a system wherein an alternate current is superimposed.

The charge control agent composition of the present invention is suitable also as a charge control agent (a charge-enhancing agent) for an electrostatic powder paint material. Namely, the electrostatic powder paint material using such a charge-enhancing agent is excellent in environmental resistance, storage stability, particularly heat stability and durability, and the paint deposition efficiency reaches 100% and it is possible to form a thick film having no painting defects.

Further, it is very effective that the charge control agent composition of the present invention is added to a carrier-coating agent for a two-component developing system. In such a case, the electrostatic charge given to the toner will be a positively charged type opposite to a case where it is used as a usual toner, but with the charge control agent composition of the present invention excellent in the rising property, the charge-imparting effect from the carrier side will also be capable of imparting a charge control effect excellent in the rising property in the same manner as in the case of using as a toner. Further, it is excellent in heat resistance and toughness and also excellent in a long term running property (plate life).

Now, the present invention will be described in further detail with reference to Examples for producing charge control agent compositions of the present invention and Examples for their use as toners, as practical examples. However, it should be understood that the present invention is by no means restricted to such Examples.

With respect to the amounts of the respective components disclosed in Examples, "parts" means "parts by mass" unless otherwise specified.

EXAMPLE 1

Preparation of Charge Control Agent Composition 1

90 Parts of a metal compound (TN-105, manufactured by Hodogaya Chemical Co., Ltd.) composed of a reaction product of 3,5-di-tert-butylsalicylic acid with zirconium oxychloride, and 10 parts of barium sulfate (BF-1, manufactured by Sakai Chemical Industry Co., Ltd.) were shaken and mixed in a plastic bag, and then, in a HENSCHEL mixer, intermittent mixing (rotation for 10 seconds, followed by standing still for 10 seconds) was repeated 10 times to obtain a charge control agent composition 1 wherein the compositional ratio of the zirconium compound of 3,5-di-tert-butylsalicylic acid to barium sulfate is 90:10.

EXAMPLE 2

Preparation of Charge Control Agent Composition 2

A charge control agent composition 2 wherein the compositional ratio of the zirconium compound of 3,5-di-tert-butylsalicylic acid to fired kaolin is 90:10 was obtained in the same manner as in Example 1 except that fired kaolin (Burgess KE, manufactured by Shiraishi Kogyo) was used instead of barium sulfate (BF-1) in Example 1.

EXAMPLE 3

Preparation of Charge Control Agent Composition 3

A charge control agent composition 3 wherein the compositional ratio of the zirconium compound of 3,5-di-tert-butylsalicylic acid to fired kaolin is 90:10, was obtained in the same manner as in Example 1 except that fired kaolin (Satintone special, manufactured by Hayashi-Kasei Co., Ltd.) was used instead of barium sulfate (BF-1) in Example 1.

EXAMPLE 4

Preparation of Charge Control Agent Composition 4

A charge control agent composition 4 wherein the compositional ratio of the zirconium compound of 3,5-di-tert-butylsalicylic acid to fired kaolin is 90:10 was obtained in the same manner as in Example 1 except that fired kaolin (Satintone 5, manufactured by Hayashi-Kasei Co., Ltd.) was used instead of barium sulfate (BF-1) in Example 1.

EXAMPLE 5

Preparation of Charge Control Agent Composition 5

A charge control agent composition 5 wherein the compositional ratio of the zirconium compound of 3,5-di-tert-butylsalicylic acid to fired kaolin is 80:20 was obtained in the same manner as in Example 4 except that the composition in Example 4 was changed to 80 parts of a metal compound (TN-105, manufactured by Hodogaya Chemical Co., Ltd.) composed of a reaction product of 3,5-di-tert-butylsalicylic acid with zirconium oxychloride, and 20 parts of fired kaolin (Satintone 5, manufactured by Hayashi-Kasei Co., Ltd.).

Preparation of Comparative Charge Control Agent Composition 1

A comparative charge control agent composition 1 wherein the compositional ratio of the zirconium compound of 3,5-di-tert-butylsalicylic acid to fired kaolin is 70:30, was obtained in the same manner as in Example 5 except that the composition in Example 5 was changed to 70 parts of a metal compound (TN-105, manufactured by Hodogaya Chemical Co., Ltd.) composed of a reaction prodcut of 3,5-di-tert-butylsalicylic acid with zorcinum oxychloride, and 30 parts of fired kaolin (Satintone 5, manufactured by Hayashi-Kasei Co., Ltd.).

Preparation of Comparative Charge Control Agent Composition 2

A comparative charge control agent composition 2 wherein the compositional ratio of the zirconium compound of 3,5-di-tert-butylsalicylic acid to fired kaolin is 50:50, was obtained in the same manner as in Example 5 except that the composition in Example 5 was changed to 50 parts of a metal compound (TN-105, manufactured by Hodogaya Chemical Co., Ltd.) composed of a reaction product of 3,5-di-tert-butylsalicylic acid with zorcinum oxychloride, and 50 parts of fired kaolin (Satintone 5, manufactured by Hayashi-Kasei Co., Ltd.).

EXAMPLE 6

Preparation of Non-Magnetic Toner 1

91 Parts of a styrene/acrylate copolymer resin (tradename CPR-100, manufactured Mitsui Chemicals, Inc., acid value: 0.1 mgKOH/g), 1.1 parts of the charge control agent composition 1 obtained in Example 1, 5 parts of carbon black (tradename MA-100, manufactured by Mitsubishi Chemical Corporation) and 3 parts of low molecular weight polypropylene (tradename VISCOL 550P, manufactured by Sanyo Chemical Industries, Ltd.) were melt-mixed by a heat mixing apparatus (twin screw extrusion kneader) of 130° C. The cooled mixture was roughly pulverized by a hammer mill and then finely pulverized by a jet mill, followed by classification to obtain a non-magnetic toner 1 having a volume average particle size of 9±0.5 μm.

This toner and a non-coated ferrite carrier (tradename F-150, manufactured by Powdertech Co., ltd.) were mixed in a mass ratio of 4:100, followed by shaking to have the toner negatively charged, whereupon the electrostatic charge was measured by a blow off powder electrostatic charge-measuring apparatus.

The time constant (τ) as an index for the electrostatic charge rising property was also calculated.

The time constant (τ) was determined in such a manner that the electrostatic charge till reaching the saturated electrostatic charge was measured every predetermined period of time by a blow off powder electrostatic charge-measuring apparatus (e.g. the following Document 1), and by the following formula, ln (qmax−q) was calculated, whereupon the relation between the time t and ln(qmax−q) was plotted in a graph, and the time constant τ was obtained.

$$(q\max-q)/(q\max-q0)=\exp(-t/\tau)$$

Here, qmax is the saturated electrostatic charge, q0 is the initial electrostatic charge (in this case, electrostatic charge after a charging time of 10 seconds), and t is each measuring time, and the electrostatic charge at that time is q. With one having good electrostatic charge rising, the time constant will have a smaller value. The unit for the time constant is seconds.

Document 1: Denshi Shashin Gakkaishi, vol. 27, No. 3, p. 307 (1988)

Further, evaluation was carried out also with respect to the environmental stability of electrostatic charge. In the method for evaluation of the environmental stability, in addition to the measurement in a usual environment at 25° C. under a 50% RH (relative humidity), the electrostatic charge measurement was carried out at a high temperature high humidity environment (at 35° C. under 85% RH). The measurement of electrostatic charge was carried out in such a manner that a developer exposed in each environment for 24 hours, then sufficiently electrostatically charged in that environment, whereupon the saturated electrostatic charge was measured by a blow off powder electrostatic charge-measuring apparatus. The judgment was made by a change in the electrostatic charge in the two exposure environments. The environmental change (%) was calculated by the following formula.

$$\text{Environmental change} = \frac{(A)-(B)}{(C)} \times 100$$

(A) Electrostatic charge under normal environment
(B) Electrostatic charge under high temperature high humidity condition
(C) Electrostatic charge under normal environment The higher the environmental stability, the smaller the value of environmental change. Evaluation of the environmental stability was made under such standards that one with an environmental change of less than 10% was rated to be excellent (◎), one with an environmental change of from 10 to 30% was rated to be good (○), one with an environmental change of from 30 to 40% was rated to be slightly poor (Δ), and one with an environmental change of more than 40% was rated to be no good (X).

The results of the electrostatic charge, time constant and environmental stability are shown in Table 1.

EXAMPLE 7

Preparation of Non-Magnetic Toners 2 to 4

Non-magnetic toners 2 to 4 were prepared in the same manner as in Example 6 including the added amounts except that instead of the charge control agent composition 1 obtained in Example 1, the charge control agent compositions 2 to 4 obtained in Examples 2 to 4 were used, respectively, and the electrostatic charge, time constant and environmental stability were evaluated by means of a blow off powder electrostatic charge-measuring apparatus. The results are shown in Table 1.

EXAMPLE 8

Preparation of Non-Magnetic Toner 5

A non-magnetic toner was prepared in the same manner as in Example 6 except that instead of the charge control agent composition 1 obtained in Example 1, the charge control agent composition 5 obtained in Example 5 was used, and the added amount was 1.25 parts, and the electrostatic charge, time constant and environmental stability were evaluated by means of a blow off powder electrostatic charge-measuring apparatus. The results are shown in Table 1.

Preparation of Comparative Non-Magnetic Toner 1

A comparative non-magnetic toner 1 was prepared in the same manner as in Example 6 except that instead of the charge control agent composition 1 obtained in Example 1, the comparative charge control agent composition 1 was used, and the added amount was 2 parts, and the electrostatic charge, time constant and environmental stability were evaluated by means of a blow off powder electrostatic charge-measuring apparatus. The results are shown in Table 1.

Preparation of Comparative Non-Magnetic Toner 2

A comparative non-magnetic toner 2 was prepared in the same manner as in Example 6 except that instead of the charge control agent composition 1 obtained in Example 1, the comparative charge control agent composition 2 was used, and the added amount was 1.44 parts, and the electrostatic charge, time constant and environmental stability were evaluated by means of a blow off powder electrostatic charge-measuring apparatus. The results are shown in Table 1.

Preparation of Comparative Non-Magnetic Toner 3

A comparative non-magnetic toner 3 was prepared in the same manner as in Example 6 except that instead of the charge control agent composition 1 obtained in Example 1, a zirconium compound of 3,5-di-tert-butylsalicylic acid (TN-105, manufactured by Hodogaya Chemical Co., Ltd.) was used, and the added amount was 1 part, and the electrostatic charge, time constant and environmental stability were evaluated by means of a blow off powder electrostatic charge-measuring apparatus. The results are shown in Table 1.

TABLE 1

| | | | Environmental stability | | |
|---|---|---|---|---|---|
| Toner | Electrostatic charge (μC/g) | Time constant τ (s) | Electrostatic charge in high temperature high humidity environment (μC/g) | Environmental change (%) | Stability |
| Non-magnetic toner 1 | −34.1 | 220 | −26.5 | 22.3 | ○ |
| Non-magnetic toner 2 | −29.8 | 133 | −28.3 | 5 | ◎ |
| Non-magnetic toner 3 | −20.2 | 133 | −20.1 | 0.5 | ◎ |
| Non-magnetic toner 4 | −20 | 147 | −14.7 | 26.5 | ○ |
| Non-magnetic toner 5 | −20.6 | 141 | −12.8 | 37.9 | Δ |
| Comparative non-magnetic toner 1 | −20.3 | 159 | −7.8 | 61.6 | X |
| Comparative non-magnetic toner 2 | −20.1 | 182 | −6.2 | 69.2 | X |
| Comparative non-magnetic toner 3 | −18.3 | 180 | −14.9 | 18.6 | ○ |

As is evident from Table 1, it has been found that with a toner employing a charge control agent composition comprising a metal compound (A) of aromatic hydroxycarboxylic acid, and an inorganic pigment (B), the electrostatic charge rising property is improved, the electrostatic charge tends to be high, and the environmental stability in a high temperature high humidity environment will be improved.

INDUSTRIAL APPLICABILITY

With the charge control agent composition of the present invention, the charge-imparting effect is high, the electrostatic charge rising rate is high, and the environmental stability in a high temperature high humidity environment is also good.

By using such a charge control agent composition, it is possible to provide a toner, whereby the initial image is extremely clear, there is no change in the image quality during continuous printing, or a change in the electrostatic charge properties due to a change of the environmental conditions such as the temperature, humidity, etc., is extremely small. Further, it is colorless and useful also for a color toner.

The entire disclosure of Japanese Patent Application No. 2006-115237 filed on Apr. 19, 2006 including specification, claims and summary is incorporated herein by reference in its entirety.

The invention claimed is:

1. A negatively chargeable toner comprising 1) a charge control agent composition comprising a metal compound (A) of aromatic hydroxycarboxylic acid having an aromatic hydroxycarboxylic acid bonded with a metal atom selected from the group consisting of a zirconium atom, a calcium atom, an aluminum atom, a chromium atom, a boron atom, and a zinc atom via at least any of ionic bond, covalent bond and coordinate bond; and at least one inorganic white pigment (B), wherein the inorganic white pigment (B) is contained in an amount of from 1 to 20 parts by mass in 100 parts by mass of the charge control agent composition, and the inorganic white pigment (B) is calcium carbonate, magnesium carbonate, barium carbonate, zinc carbonate, barium sulfate, calcium sulfate, magnesium hydroxide, aluminum hydroxide, calcium silicate, aluminum silicate, zinc silicate, magnesium silicate, dimagnesium phosphate, titanium dioxide, kaolin, talc, clay, diatomaceous earth, synthetic amorphous silica, alumina, or zeolite;

2) a colorant; and 3) a binder resin, wherein the charge control agent composition is incorporated throughout the toner.

2. The negatively chargeable toner according to claim 1, wherein the metal compound (A) of aromatic hydroxycarboxylic acid is a metal compound having 3,5-di-tert-butylsalicylic acid bonded with a metal atom selected from the group consisting of a zirconium atom, a calcium atom, an aluminum atom, a chromium atom, a boron atom, and a zinc atom.

3. The negatively chargeable toner according to claim 1, wherein the content of the charge control agent composition is from 0.1 to 10 parts by mass per 100 parts by mass of the binder resin.

4. The negatively chargeable toner according to claim 1, wherein the binder resin has an acid value of from 0.1 to 100 mgKOH/g.

5. The negatively chargeable toner according to claim 1, wherein the colorant is a magnetic substance.

6. The negatively chargeable toner according to claim 1, wherein the colorant is a non-magnetic colorant, and its content is from 0.1 to 20 parts by mass per 100 parts by mass of the binder resin.

7. A one component developer comprising the negatively chargeable toner as defined in claim 1.

8. A two component developer comprising a negatively chargeable toner and a carrier, wherein the negatively chargeable toner is the negatively chargeable toner as defined in claim 1.

9. A negatively chargeable toner comprising:

1) a charge control agent composition comprising a metal compound (A) of aromatic hydroxycarboxylic acid having an aromatic hydroxycarboxylic acid bonded with a metal atom selected from the group consisting of a zirconium atom, a calcium atom, an aluminum atom, a chromium atom, a boron atom, and a zinc atom via at least any of ionic bond, covalent bond and coordinate bond; and at least one inorganic white pigment (B), wherein the inorganic white pigment (B) is contained in an amount of from 1 to 20 parts by mass in 100 parts by mass of the charge control agent composition, and the inorganic white pigment (B) is calcium carbonate, magnesium carbonate, barium carbonate, zinc carbonate, barium sulfate, calcium sulfate, magnesium hydroxide, aluminum hydroxide, calcium silicate, aluminum silicate, zinc silicate, magnesium silicate, dimagnesium phosphate, titanium dioxide, kaolin, talc, clay, diatomaceous earth, synthetic amorphous silica, alumina, or zeolite;

2) a colorant; and 3) a binder resin, which toner is formed by combining the charge control agent composition, the colorant, and the binder resin; kneading to incorporate the charge control agent composition and the colorant through in the binder resin and to form a kneaded composition; and pulverizing the kneaded composition.

10. The negatively chargeable toner according to claim 9, wherein the kneading is heat-kneading.

* * * * *

UNITED STATES PATENT AND TRADEMARK OFFICE

CERTIFICATE OF CORRECTION

PATENT NO. : 8,580,470 B2
APPLICATION NO. : 12/297819
DATED : November 12, 2013
INVENTOR(S) : H. Otsuka et al.

It is certified that error appears in the above-identified patent and that said Letters Patent is hereby corrected as shown below:

In the Claims

Column 30, line 47, claim 9, please change "colorant through in" to -- colorant in --

Signed and Sealed this
Fifteenth Day of July, 2014

Michelle K. Lee

Michelle K. Lee
*Deputy Director of the United States Patent and Trademark Office*